US005164556A

United States Patent [19]

Yoshimura et al.

[11] Patent Number: 5,164,556

[45] Date of Patent: Nov. 17, 1992

[54] ACCELERATION SENSOR

[75] Inventors: Kazuo Yoshimura; Shigeru Shimozono; Ryo Satoh, all of Kanagawa, Japan

[73] Assignee: Takata Corporation, Tokyo, Japan

[21] Appl. No.: 735,936

[22] Filed: Jul. 25, 1991

[30] Foreign Application Priority Data

Aug. 23, 1990 [JP] Japan ..... 2-221996
Aug. 23, 1990 [JP] Japan ..... 2-221997

[51] Int. Cl.[5] ..... H01H 35/14
[52] U.S. Cl. ..... 200/61.45 M; 200/61.53
[58] Field of Search ..... 200/61.45 R, 61.45 M, 200/61.53, 268; 335/196, 205, 206, 207

[56] References Cited

U.S. PATENT DOCUMENTS

| | | | |
|---|---|---|---|
| 2,932,703 | 4/1960 | Haberland | 335/196 |
| 3,132,220 | 5/1964 | Uri et al. | 200/61.45 R |
| 3,171,913 | 3/1965 | Kersh | 200/61.53 |
| 4,128,823 | 12/1978 | Tanaka et al. | 200/268 X |
| 4,827,091 | 5/1989 | Behr | 200/61.45 M |
| 4,873,401 | 10/1989 | Ireland | 200/61.45 M |

*Primary Examiner*—J. R. Scott
*Attorney, Agent, or Firm*—Kanesaka and Takeuchi

[57] ABSTRACT

An acceleration sensor comprising a cylinder of a conductive material, a magnetized inertial member mounted in the cylinder so as to be movable longitudinally of the cylinder, a conductive member mounted at least on an end surface of the inertial member that is on a side of one longitudinal end of the cylinder, a pair of electrodes disposed at this one longitudinal end of the cylinder, and an attracting member disposed on a supporting device near the other longitudinal end of the cylinder. When the conductive member of the inertial member comes into contact with the electrodes, these electrodes are caused to conduct via the conductive member. The attracting member is made of a magnetic material such that the attracting member and the inertial member are magnetically attracted toward each other. The magnetized inertial member comprises a core including a cylindrical permanent magnet, a hard plating layer formed on the curved surface of the core, and a conductive plating layer formed at an end surface of the core that is located on a side of the electrodes. Another magnetized inertial member comprises a cylindrical core including a permanent magnet, a synthetic resin layer enclosing the curved surface of the core, and a conductive plating layer formed on the end surface of the core that is located on the side of the electrodes.

20 Claims, 4 Drawing Sheets

ACCELERATION SENSOR

FIELD OF THE INVENTION

The present invention relates to an acceleration sensor and, more particularly, to an acceleration sensor adapted to detect a large change in the speed of a vehicle caused by a collision or the like.

BACKGROUND OF THE INVENTION

An acceleration sensor of this kind is described in U.S. Pat. No. 4,827,091. This known sensor comprises a cylinder made of a conductive material, a magnetized inertial member mounted in the cylinder so as to be movable longitudinally of the cylinder, a conductive member mounted at least on an end surface of the inertial member which is on a side of one longitudinal end of the cylinder, a pair of electrodes disposed at the one longitudinal end of the cylinder, and an attracting member disposed near the other longitudinal end of the cylinder When the conductive member of the magnetized inertial member makes contact with the electrodes, these electrodes are caused to conduct via the conductive member. The attracting member is made of such a magnetic material that the attracting member and the inertial member are magnetically attracted towards each other.

In this acceleration sensor, the magnetized inertial member and the attracting member attract each other. When no or almost no acceleration is applied to the sensor, the inertial member is at rest at the other end in the cylinder.

If a relatively large acceleration acts on this acceleration sensor, the magnetized inertial member moves against the attracting force of the attracting member. During the movement of the inertial member, an electrical current is induced in this cylinder, producing a magnetic force which biases the inertial member in the direction opposite to the direction of movement of the inertial member. Therefore, the magnetized inertial member is braked, so that the speed of the movement is reduced.

When the acceleration is less than a predetermined magnitude, or threshold value, the magnetized inertial member comes to a stop before it reaches the front end of the cylinder. Then, the inertial member is pulled back by the attracting force of the attracting member.

When the acceleration is greater than the predetermined magnitude, or the threshold value, e.g., the vehicle carrying this acceleration sensor collides with an object, the inertial member arrives at the one end or front end of the cylinder. At this time, the conductive layer on the front end surface of the inertial member makes contact with both electrodes to electrically connect them with each other. If a voltage has been previously applied between the electrodes, an electrical current flows when a short circuit occurs between them. This electrical current permits detection of collision of the vehicle.

As shown in FIG. 2, the conventional magnetized inertial member 1 consists of a magnet assembly comprising a permanent magnet 2 enclosed in a case 3 made of copper. A packing 4 is made of a synthetic resin. This case 3 permits the magnetized inertial member 1 to smoothly slide along the inner surface of the cylinder. If the vehicle collides with an object, the inertial member 1 receives an acceleration. At this time, the inertial member 1 moves and allows the case to contact with the electrodes, thus causing them to conduct, i.e., they are short-circuited.

When the conventional magnetized inertial member 1 shown in FIG. 2 is assembled, the magnet 2 is inserted into the case 3. Then, the packing 4 is loaded into it. Subsequently, one end portion of the case 3 is bent inwardly. In this way, laborious steps are needed.

SUMMARY OF THE INVENTION

It is an object of the present invention to provide an acceleration sensor having a magnetized inertial member which is mounted in a cylinder and which can be quite easily, quickly, and economically fabricated.

It is another object of the invention to provide an acceleration sensor which has an inexpensive magnetized inertial member mounted in a cylinder, whereby the sensor can be fabricated more economically than heretofore.

In accordance with one aspect of the invention, there is provided an acceleration sensor comprising: a cylinder made of a conductive material; a magnetized inertial member mounted in the cylinder so as to be movable longitudinally of the cylinder; a conductive member mounted at least on an end surface of the inertial member which is on a side of one longitudinal end of the cylinder; a pair of electrodes which are disposed at this one longitudinal end of the cylinder and which, when the conductive member of the inertial member makes contact with the electrodes, are caused to conduct via the conductive member; and an attracting member disposed near the other longitudinal end of the cylinder and made of a magnetic material, the attracting member and the inertial member being magnetically attracted toward each other. The magnetized inertial member comprises a cylindrical core consisting of a permanent magnet, and a hard plating layer formed on a curved surface of the core. The conductive member is a conductive plating layer formed on an end surface of the core that is on the side of the electrodes.

In this acceleration sensor, the magnetized inertial member is fabricated by plating the outer surface of the core consisting of a permanent magnet. Therefore, it is very easy to fabricate.

Since the curved surface of the magnetized inertial member is plated with a hard metal, this inertial member smoothly slides along the inner surface of the cylinder. In addition, the inertial member is excellent in wear resistance and highly durable.

If the vehicle collides with an object, the magnetized inertial member receives an acceleration and is moved to contact with the electrodes. At this time, the conductive plating layer formed on the front end surface of the inertial member short-circuits the electrodes. This permits detection of the collision of the vehicle.

In accordance with another feature of the invention, there is provided an acceleration sensor comprising: a cylinder made of a conductive material; a magnetized inertial member mounted in the cylinder so as to be movable longitudinally of the cylinder; a conductive member mounted at least on an end surface of the inertial member which is located on a side of one longitudinal end of the cylinder; a pair of electrodes which are disposed at this one longitudinal end of the cylinder and which, when the conductive member of the inertial member makes contact with the electrodes, are caused to conduct via the conductive member; and an attracting member disposed near the other longitudinal end of the cylinder and made of a magnetic material, the attracting member and the inertial member being magnetically attracted toward each other. The magnetized inertial member comprises a cylindrical core consisting of a permanent magnet, a synthetic resin layer enclosing a curved surface of the core. The conductive member is a conductive plating layer formed on an end surface of the core that is on the side of the electrodes.

In this acceleration sensor, the magnetized inertial member is fabricated by enclosing the curved, surface of the core of the permanent magnet with the synthetic resin and plating the front end surface. Hence, the inertial member is very easy to fabricate.

Since the curved surface of the magnetized inertial member is enclosed with the synthetic resin layer, this inertial member smoothly slides along the inner surface of the cylinder. In addition, the inertial member is excellent in wear resistance and highly durable.

If the vehicle collides with an object, the magnetized inertial member receives an acceleration and is moved to contact with the electrodes. At this time, the conductive plating layer formed on the front end surface of the inertial member short-circuits the electrodes. This permits detection of the collision of the vehicle.

DETAILED DESCRIPTION OF THE INVENTION

Figure 1:
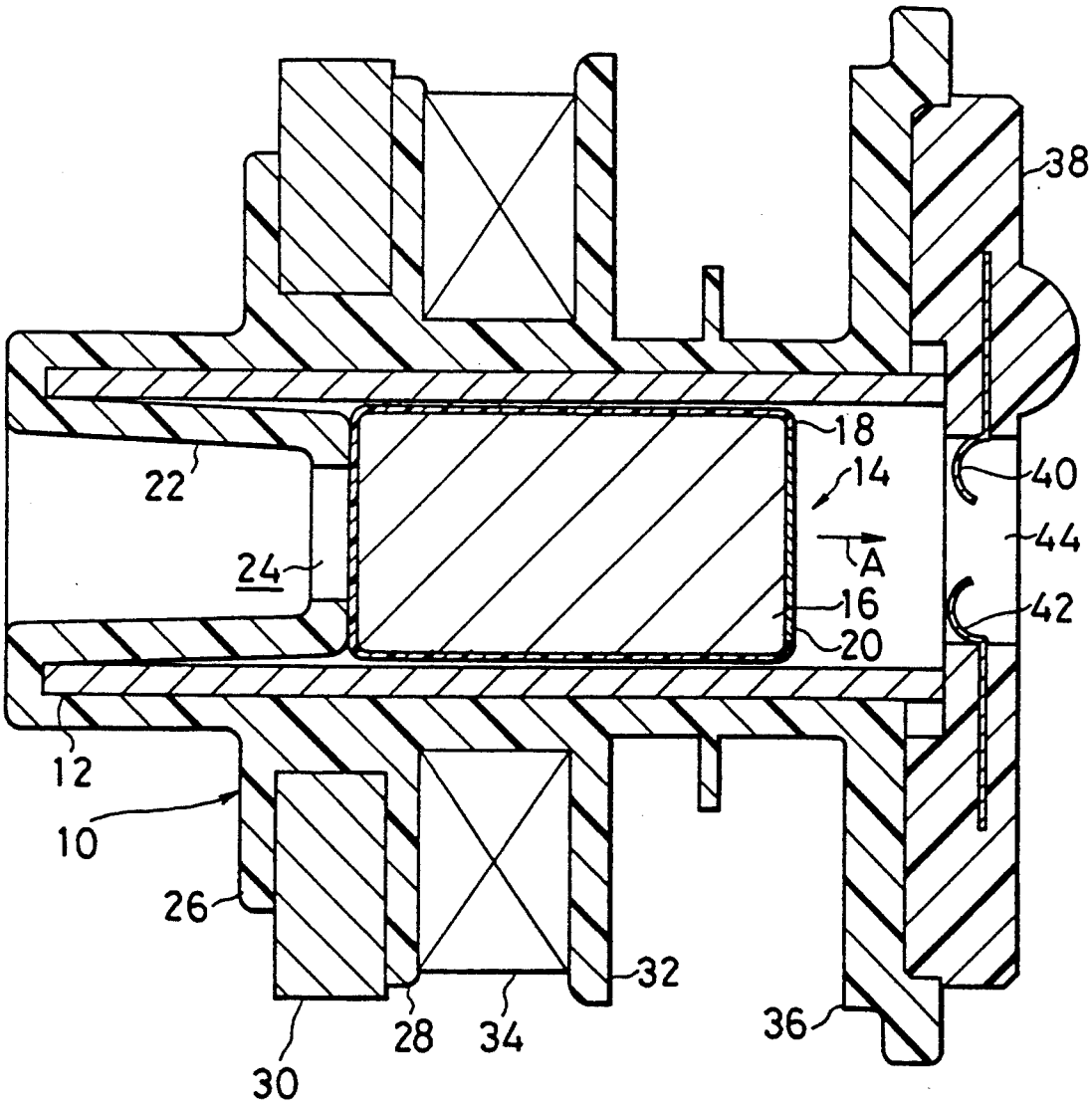
FIG. 1 is a cross-sectional view of an acceleration sensor according to the invention.
Figure 2:
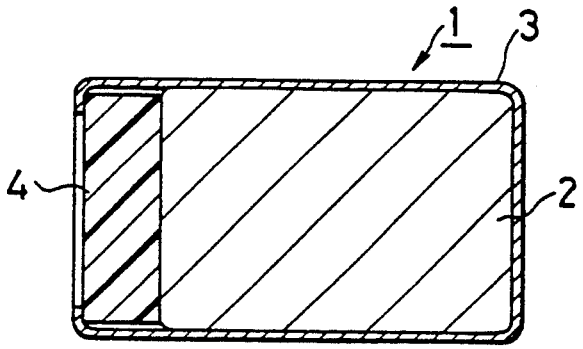
FIG. 2 PRIOR ART
FIG. 2 is a cross-sectional view of the prior art magnetized inertial member.

Referring to FIG. 1, there is shown an acceleration sensor according to the invention. This sensor has a cylindrical bobbin 10 made of a nonmagnetic material such as a synthetic resin. A cylinder 12 made of a copper alloy is held inside the bobbin 10. A magnetized inertial member 14 is mounted in the cylinder 12. This inertial member 14 comprises a core 16 made of a cylindrical permanent magnet, a plating layer 18 formed on a curved surface of the core 16, and a second plating layer 20 formed on the front end surface of the core 16. The plating layer 18 is made of a hard metal. The second plating layer 20 is made of a conductive metal. The inertial member 14 is disposed in the cylinder 12 in such a way that it can move longitudinally of the cylinder 12.

Examples of the hard metal forming the plating layer 18 on the curved surface include nickel, chromium, and zinc. Among these, nickel is preferable.

Examples of the conductive metal forming the plating layer 20 on the front end surface include gold, silver, and nickel silver (i.e., a copper alloy consisting of 45–65% by weight of Cu, 6–35% by weight of Ni, and 15–35% by weight of Zn). Among these, gold is preferable.

In the present example, the rear end surface of the core 16 is also coated with the hard plating layer 18. Therefore, all the outer surfaces of the core 16 are coated with the plating layers 18 and 20. In this case, the magnet 16 is prevented from chipping.

The bobbin 10 has an insert portion 22 at its one end. This insert portion 22 is located in the cylinder 12. An opening 24 is formed at the front end of the insert portion 22. A pair of flanges 26 and 28 protrudes laterally from the bobbin 10 near the front end of the insert portion 22. An annular attracting member or return washer 30 which is made of a magnetic material such as iron is held between the flanges 26 and 28.

The bobbin 10 has another flange 32. A coil 34 is wound between the flanges 28 and 32. A further flange 36 is formed at the other end of the bobbin 10. A contact holder 38 is mounted to this flange 36.

This contact holder 38 is made of a synthetic resin. A pair of electrodes 40 and 42 is buried in the holder 38. An opening 44 is formed in the center of the holder 38. The front ends of the electrodes 40 and 42 protrude into the opening 44. The electrodes 40 and 42 have arc-shaped front end portions. Parts of the arc-shaped front end portions are substantially flush with the front end surface of the cylinder 12.

Lead wires (not shown) are connected with the rear ends of the electrodes 40 and 42 to permit application of a voltage between them.

The operation of the acceleration sensor constructed as described thus far is now described. When no external force is applied, the magnetized inertial member 14 and the return washer 30 attract each other. Under this condition, the rear end of the inertial member 14 is in the illustrated rearmost position where it abuts against the front end surface of the insert portion 22. If an external force acts in the direction indicated by an arrow A, then the magnet assembly 14 moves in the direction indicated by the arrow A against the attracting force of the return washer 30. This movement induces an electrical current in the cylinder 12 made of a copper alloy, thus producing a magnetic field. This magnetic field applies a magnetic force to the inertial member 14 in the direction opposite to the direction of the movement. As a result, the inertial member 14 is braked.

Where the external force applied to the acceleration sensor is small, the magnetized inertial member 14 comes to a stop on its way to one end of the cylinder 12. The inertial member 14 is shortly returned to its rearmost position shown in FIG. 1 by the attracting force acting between the return washer 30 and the inertial member 14.

If a large external force is applied in the direction indicated by the arrow A when the vehicle collides, then the inertial member 14 is advanced up to the front end of the cylinder 12 and comes into contact with the electrodes 40 and 42. At this time, the plating layer 20 on the inertial member 14 which is made of a conductive material creates a short-circuit between the electrodes 40 and 42, thus producing an electrical current between them. This permits detection of an acceleration change greater than the intended threshold value. Consequently, the collision of the vehicle is detected.

The aforementioned coil 34 is used to check the operation of the acceleration sensor. In particular, when the coil 34 is electrically energized, it produces a magnetic field which biases the inertial member 14 in the direction indicated by the arrow A. The magnet assembly 14 then advances up to the front end of the cylinder 12, short-circuiting the electrodes 40 and 42. In this way, the coil 34 is energized to urge the inertial member 14 to move. Thus, it is possible to make a check to see if the inertial member 14 can move back and forth without trouble and if the electrodes 40 and 42 can be short-circuited.

Figure 3:
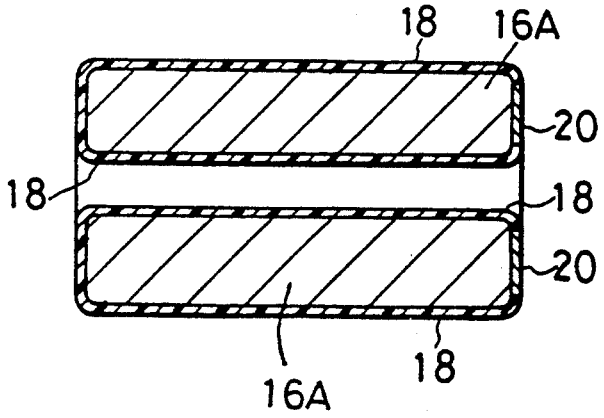
FIG. 3 is a cross-sectional view of a magnetized inertial member used in another acceleration sensor according to the invention.

In the above example, the magnet 16 taking the form of a solid cylinder is used in the magnetized inertial member 14. A core 16A assuming the form of a hollow cylinder as shown in FIG. 3 may also be employed. The hard plating layer 18 is formed on the curved outer surface, on the inner surface, and on the rear end surface of the core 16A. The conductive plating layer 20 is formed on the front end surface. Also, in this case, the outer surface of the core 16A is totally coated with the plating layers 18 and 20 and so the core 16A is kept from chipping.

Figure 4:
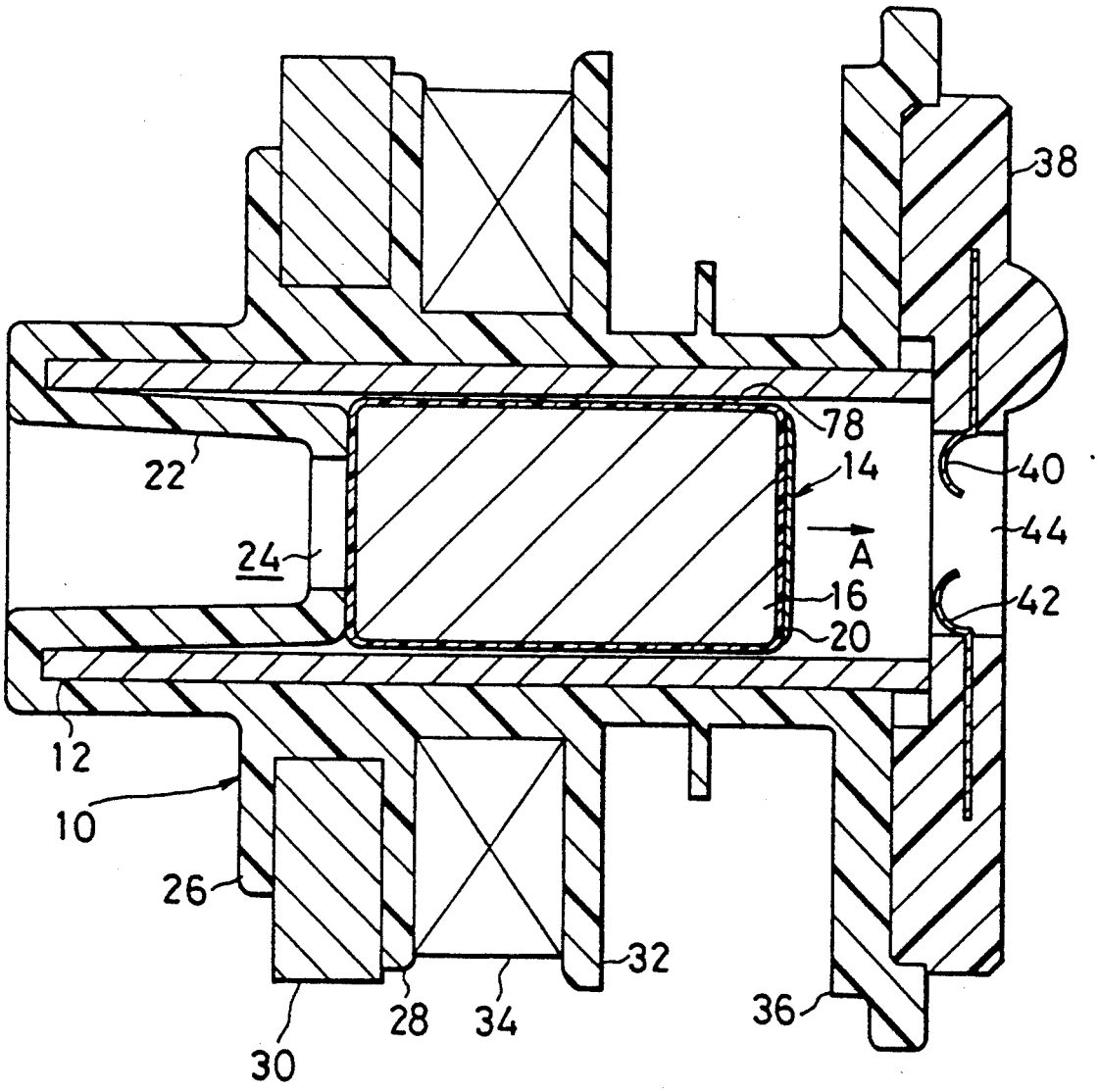
FIG. 4 is a cross-sectional view of a further acceleration sensor according to the invention.

Referring next to FIG. 4, there is shown another acceleration sensor according to the invention. This sensor has a cylindrical bobbin 10 made of a nonmagnetic material such as a synthetic resin. A cylinder 12 made of a copper alloy is held inside the bobbin 10. A magnetized inertial member 14 is mounted in the cylinder 12. This inertial member 14 comprises a core 16 made of a cylindrical permanent magnet, a synthetic resin layer 78 enclosing a curved surface of the core 16, and a plating layer 20 formed on the front end surface of the core 16. The plating layer 20 is made of a conductive metal and formed on the synthetic resin layer 78. The inertial member 14 is disposed in the cylinder 12 so as to be movable longitudinally of the cylinder 12.

Examples of the synthetic resin 78 on the curved surface include epoxy, POM (polyoxymethylene), and ABS (acrylonitrile-butadiene-styrene).

Examples of the conductive metal forming the plating layer 20 on the front end surface include gold, silver, and nickel silver. Among these, gold is preferable.

In the present example, the whole outer surfaces of the core 16 are coated with the synthetic resin layer 78. Thus, the core 16 is prevented from chipping.

This sensor shown in FIG. 4 is similar in structure and operation to the sensor already described in connection with FIG. 1 except for the foregoing. Note that like components are indicated by like reference numerals in various figures. Those components which have been already described are not described here.

Figure 5:
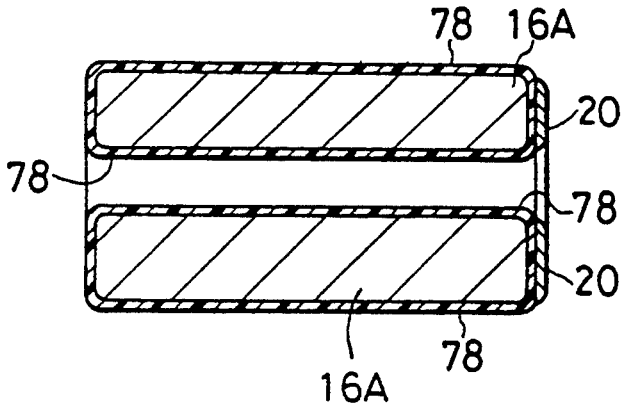
FIGS. 5 and 6 are cross-sectional views of magnetized inertial members used in other acceleration sensors according to the invention.

In the example shown in FIG. 4, the core 16 which takes a form of a solid cylinder is used in the magnetized inertial member 14. A Core 16A that assumes a form of a hollow cylinder as shown in FIG. 5 may be used instead. The outer surfaces of the core 16A are totally coated with the synthetic resin layer 78. The synthetic resin layer 78 formed on the front end surface is coated with the conductive plating layer 20. Also in this case, the core 16A is prevented from chipping, because the whole outer surfaces of the core 16A are coated with the synthetic resin layer 78.

Figure 6:
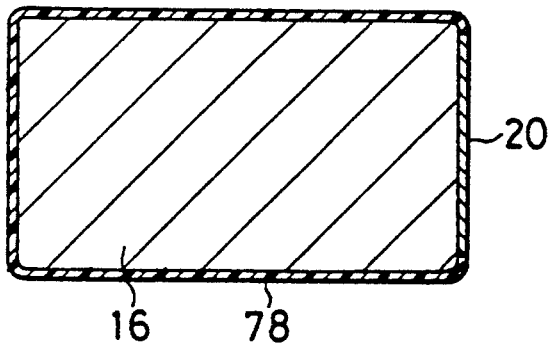

In the example of FIG. 4, the plating layer 20 is formed on the portion of the synthetic resin layer 78 which overlies the front end surface of the core 16 or 16A. As shown in FIG. 6, the synthetic resin layer may be omitted from the front end surface. Instead, the conductive plating layer 20 may be formed directly on the core 16 or 16A.

What is claimed is:

1. An acceleration sensor comprising:

a cylinder made of a conductive material and having longitudinal ends;

means for supporting said cylinder situated outside said cylinder;

an inertial member mounted in said cylinder so as to be movable longitudinally of said cylinder, said inertial member including a cylindrical core made of a permanent magnet, a hard plating layer formed on an outer curved surface of the core and a conductive plating layer formed on one end surface of the core facing one of the longitudinal ends of said cylinder;

a pair of electrodes disposed adjacent to said one longitudinal end of said cylinder facing the conductive plating layer and supported by the supporting means, said electrodes, when the conductive plating layer of said inertial member makes contact with said electrodes, being caused to conduct through the conductive plating layer; and an attracting member disposed outside said cylinder and supported by the supporting means near the other of the longitudinal ends, said attracting member being made of a magnetic material, said attracting member magnetically attracting said inertial member.

2. The acceleration sensor of claim 1, wherein said core has an end surface on a side opposite to the conductive plating layer, said end surface having a hard plating layer.

3. The acceleration sensor of claim 1, wherein said core takes a form of a solid cylinder.

4. The acceleration sensor of claim 1, wherein said core takes a form of a hollow cylinder.

5. The acceleration sensor of claim 4, wherein said core further includes an inner surface in the hollow cylinder, said inner and outer surfaces and the end surface of the core at a side opposite to the electrodes include hard plating layers.

6. The acceleration sensor of claim 1, wherein said hard plating layer is a layer of plating of a metal.

7. The acceleration sensor of claim 6, wherein said metal is nickel.

8. The acceleration sensor of claim 6, wherein the metal is selected from a group consisting of nickel, chromium and zinc.

9. The acceleration sensor of claim 1, wherein said conductive plating layer is made of a conductive metal.

10. The acceleration sensor of claim 9, wherein said conductive metal is selected from a group consisting of gold, silver and nickel silver.

11. An acceleration sensor comprising:

a cylinder made of a conductive material and having longitudinal ends;

means for supporting said cylinder situated outside said cylinder;

an inertial member mounted in said cylinder so as to be movable longitudinally of said cylinder, said inertial member including a cylindrical core made of a permanent magnet, a synthetic resin layer covering an outer curved surface of the core and a conductive plating layer formed on one end surface of the core facing one of the longitudinal ends of the cylinder;

a pair of electrodes disposed adjacent to said one longitudinal end of said cylinder facing the conductive plating layer and supported by the supporting means, said electrodes, when the conductive plating layer of said inertial member makes contact with said electrodes, being caused to conduct through the conductive plating layer; and an attracting member disposed outside said cylinder and supported by said supporting means near the other of the longitudinal ends, said attracting member being made of a magnetic material, said attracting member magnetically attracting said inertial member.

12. The acceleration sensor of claim 11, wherein said core takes a form of a solid cylinder.

13. The acceleration sensor of claim 11, wherein said core takes a form of a hollow cylinder.

14. The acceleration sensor of claim 11, wherein said conductive plating layer is made of a conductive metal.

15. The acceleration sensor of claim 14, wherein the conductive metal is a metal selected from a group consisting of gold, silver and nickel silver.

16. The acceleration sensor of claim 11, wherein said core has an end surface on a side opposite to the conductive plating layer, said end surface having a synthetic resin layer.

17. The acceleration sensor of claim 11, wherein the resin layer is made of a resin selected from a group consisting of epoxy, POM and ABS.

18. The acceleration sensor of claim 17, wherein said resin is an epoxy resin.

19. The acceleration sensor of claim 11, wherein said resin layer covers a whole surface of the core, said conductive plating layer being fixed to the resin layer on the end surface of the core on the side of the electrodes.

20. The acceleration sensor of claim 11, wherein the resin layer covers a whole surface of the core except for the one end surface facing the electrodes, and said conductive plating layer is a conductive metal directly plated on said one end surface of the core.

* * * * *